United States Patent [19]

Trepaud

[11] Patent Number: 4,573,528

[45] Date of Patent: Mar. 4, 1986

[54] HEAT EXCHANGERS WITH CLUSTERS OF STRAIGHT OR CORRUGATED TUBES, ESPECIALLY TO SYSTEMS FOR SUPPORTING THE TUBES AT FIXED AND MOVABLE AXIAL LEVELS

[76] Inventor: Georges Trepaud, 1, Rond Point Bugeaud, 75016 Paris, France

[21] Appl. No.: 335,537

[22] Filed: Dec. 29, 1981

[30] Foreign Application Priority Data

Jan. 8, 1981 [FR] France ..... 81 00212
Feb. 16, 1981 [FR] France ..... 81 02993

[51] Int. Cl.[4] ..... F28D 7/08; F28F 9/00; F28F 9/22

[52] U.S. Cl. ..... 165/162; 165/161

[58] Field of Search ..... 165/162, 159, 161; 122/510

[56] References Cited

U.S. PATENT DOCUMENTS

| | | | |
|---|---|---|---|
| 2,942,855 | 6/1960 | Wellenisiek | 165/159 |
| 2,978,226 | 4/1961 | White | 165/162 |
| 3,336,974 | 8/1967 | Bernstein et al. | 165/162 |
| 3,420,297 | 1/1969 | Ramanos | 165/162 |
| 3,626,481 | 12/1971 | Taylor | 165/162 |
| 3,683,866 | 11/1970 | Zmola | 165/162 |
| 3,782,455 | 1/1974 | Wolowodiuk et al. | 165/162 |
| 3,989,105 | 11/1976 | Trepaud | 165/162 |
| 4,058,161 | 11/1977 | Trepaud | 165/162 |
| 4,154,295 | 5/1979 | Kissinger | 165/162 |
| 4,253,516 | 3/1981 | Giardina | 165/162 |
| 4,325,171 | 4/1982 | Nobles | 165/159 |

FOREIGN PATENT DOCUMENTS

| | | | |
|---|---|---|---|
| 2727032 | 12/1977 | Fed. Rep. of Germany | 165/162 |
| 2459441 | 2/1981 | France | 165/162 |
| 1591784 | 5/1978 | United Kingdom . | |

*Primary Examiner*—William R. Cline
*Assistant Examiner*—John K. Ford
*Attorney, Agent, or Firm*—Frishauf, Holtz, Goodman & Woodward

[57] ABSTRACT

An improved heat exchanger, applicable especially, but not exclusively, to a steam generator, preferably with straight or corrugated tubes (5) arranged in vertical concentric rows. The tubes (5) are maintained at certain axial levels thereof by concentric supporting systems, each of which consists of a zigzag circular strip (21) having alternate trapezoidal cells, and welded to a surrounding supporting strip (20). In the systems disposed at uncorrugated or "fixed" axial levels, the zigzag strip cells are shut off, after installation of the tubes (5), by a closing strip (22) to which is welded the supporting strip (20*n*) of the supporting system which is adjacent along the radial direction of the cylindrical casing (11), characterized in that at least some of the supporting systems (20, 21 . . . 20*n*, 21*n*) are independent of the supporting systems in the radial direction and form groups of supporting systems, and in that radial arms (14, 14', 14*n*) are provided for retaining said independent supporting systems.

8 Claims, 12 Drawing Figures

FIG.7
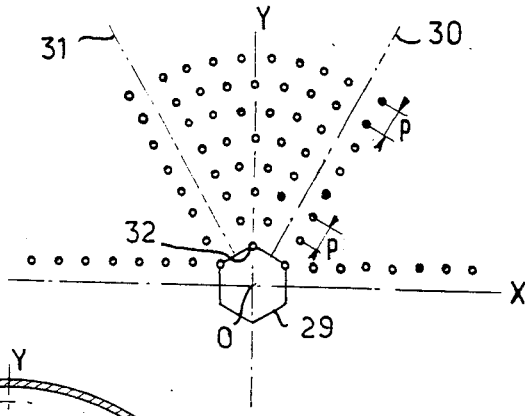
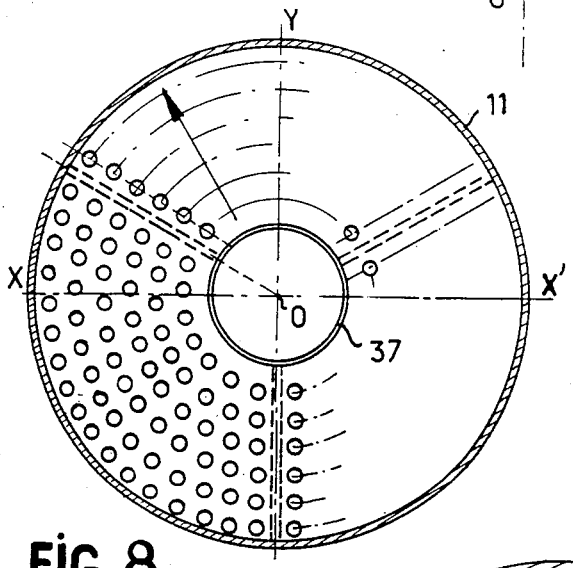
FIG. 8
FIG.5
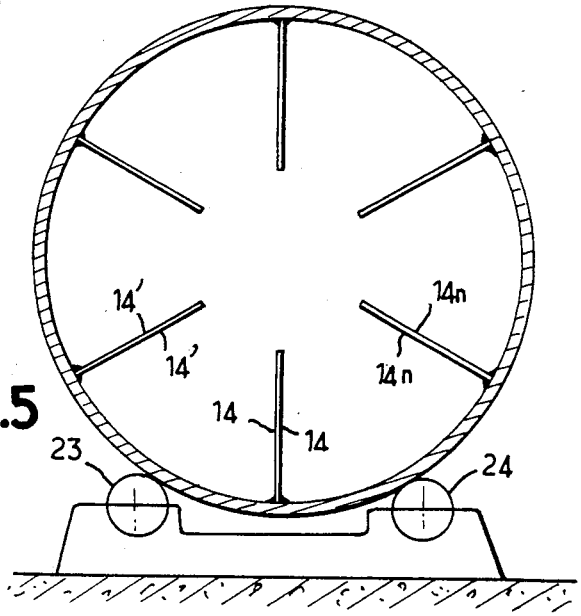

HEAT EXCHANGERS WITH CLUSTERS OF STRAIGHT OR CORRUGATED TUBES, ESPECIALLY TO SYSTEMS FOR SUPPORTING THE TUBES AT FIXED AND MOVABLE AXIAL LEVELS

The present invention relates to an improved heat exchanger, applicable especially, but not exclusively, to a steam generator, perhaps with straight tubes, but preferably with corrugated tubes arranged in vertical concentric annular rows and maintained at certain levels by concentric supporting systems, each of which consists of a zigzag circular strip, which has alternating trapezoidal cells and which is welded to a supporting strip and shut off by a closing strip, to which is welded the strip for supporting the supporting system which follows in the radial direction of the cylindrical casing. These supporting systems have been described in published French Patent Application No. 78-08718, filed on Mar. 24th, 1978, to which corresponds the patent granted in Great Britain under No. 1,591,784.

In the preferred case in which corrugated tubes are used, these tubes have corrugations or bulges located on a particular side of the axis passing through the straight ends of the tubes, which ends are maintained in corresponding orifices provided in the end plates of the cylindrical casing, at the base of the two domes generally used in this type of appliance. The tubes are arranged so that the planes containing their corrugations or bulges are substantially tangent to the circles of the associated annular clusters of tubes provided between the cylindrical casing and a central tube of the heat exchanger.

Because of the differences in temperature of the fluids present in the appliance, the corrugated tubes contract or expand, more particularly at the level of the corrugations of which the cambers or deflections vary, this resulting in a tangential force which is exerted on the various supporting systems in the cells of which the corrugated parts of the tubes are retained. Also, in a particular sector of the concentric supporting systems located at a particular level, the peripheral displacement of the various portions of the supporting systems of this sector increases from the center 17 towards the cylindrical casing 11.

Since the prior art supporting systems located at a particular level are welded to one another, detrimental tensions can arise under certain thermal operating conditions and can lead, at the very least, to damage to these supporting systems.

Therefore, to overcome this disadvantage, it is envisaged, according to the invention, that at least some of the supporting systems located at a particular level are independent of the adjacent supporting systems and form concentric groups of supporting systems, and that, for retaining said independent supporting systems, radial arms are provided in the space located between the cylindrical casing 11 and the central tube 17.

According to a preferred embodiment, which ensures complete flexibility of all the supporting systems, all the movable supporting systems of a particular level are independent of one another, and radial arms are provided on either side of the assembly of the supporting systems of a particular level.

By means of this arrangement, the supporting systems independent of one another and belonging to a particular level are maintained in place between the cylindrical casing 11 and the central tube 17 of the heat exchanger, and can therefore also be assembled and transported in a horizontal position.

Advantageously, each radial arm consists of two flatt butt-welded iron bars, with a certain distance between them.

According to another embodiment (FIG. 3), there are, at least at some levels, two concentric rings, one of which is located near the inner surface of the cylindrical casing and the other near the outer surface of the central tube, and the first can be welded to the cylindrical casing and the second (at 16) to said central tube, thus making it possible to improve the retention of the supporting systems.

In the event that it is intended to provide the appliance, at least at some levels, with a system of deflectors so as to subject the circulation of the fluid in the cylindrical casing to a certain course in order to control its flow so as to obtain a better coefficient of heat transmission, it is envisaged, according to the invention, to associate with at least some zigzag circular strips having trapezoidal cells, particular strips in the form of combs which extend over arcs of suitable length and the teeth of which, extending radially towards the centre, pass respectively between two adjacent tubes so as to shut off to the maximum extent the gaps which can exist between the latter, these combs being placed flat on the cellular strip and being welded to the adjacent supporting strip.

Advantageously, the combs arranged at a given level are offset angularly in relation to the combs arranged at the following level and at the preceding level, the angular offset being such that the projection in a horizontal plane of two combs located at two successive levels is a ring extending over 360°. Preferably, the comb of each level extends in an arc of 300°, but it can also extend over 180° or less. It goes without saying that combs extending over such arcs consist of pieces of combs which are coextensive and welded to one another.

As a general rule, a heat exchanger, and more particularly a steam generator, is an appliance of large dimensions, and, for the sake of convenience, the cylindrical casing is placed horizontally on electrical turning devices so as to enable the clusters and supporting systems to be installed in sectors of 60° or, if appropriate, 120°.

To permit this installation under good conditions, the invention proposes a process in which the radial arms welded to the inner surface of the cylindrical casing or to the ring adjacent thereto are supported by means of flat iron stiffening bars which are welded by their ends to the base plates in which the ends of the tubes are retained, and which are provided with orifices for passage of the free ends of the radial arms; after the cluster of tubes and the supporting systems have been installed, these flat iron stiffening bars are removed, and the central tube is put in place and is welded to said radial arms via orifices which it contains, and this central tube can, if appropriate, be produced in the cylindrical casing as a result of the assembly and welding of individual wall elements.

However, it is also conceivable, and generally more advantageous, to carry out the installation of the clusters of tubes, the supporting systems and the radial arms by operating from the outer surface of the central tube, suitable supports being provided, if necessary, to support the radial arms temporarily and to ensure their radial position these supports then being eliminated to enable the cylindrical casing to be installed.

In the particular case of corrugated tubes having straight portions between the successive corrugations, it has been mentioned that, because of the expansions of the tubes at the level of the corrugations, the camber of each of these can increase under certain thermal conditions, and to take these conditions into account, it has been proposed that, at these levels, the concentric supporting systems should be independent of one another and rest on a radial arm or should be located between pairs of sets of two radial arms located between the cylindrical casing and the central tube. In the following, these levels will be designated by "mobility levels" or, more briefly, by "movable level".

In contrast to this, at the level of the straight portions of the tubes located between two corrugations, there is no expansion which can lead to mobility in a peripheral direction of the concentric supporting systems provided at this level, and these levels will be designated by "fixed levels". Therefore it will be possible to provide, at these fixed levels, welds between the radial arms and at least some of the supporting systems; these welds can be made between the radial arm or arms, on the one hand, and one or other of the strips constituting the supporting systems, on the other hand.

By way of example, various embodiments of the subject of the invention have been described below and illustrated in the attached drawing.

FIG. 5 is an axial cross-section along the line V—V of FIG. 4, showing two of the electrical turning devices on which the appliance of FIG. 4 rests.

FIG. 7 shows a diagram making it possible to determine the distribution of the tubes in sectors of 60°.

FIG. 8 is a diagrammatic and partial cross-section showing the arrangement of a cluster of tubes distributed in sectors of 120° between the cylindrical casing and the central tube.

Figure 1:
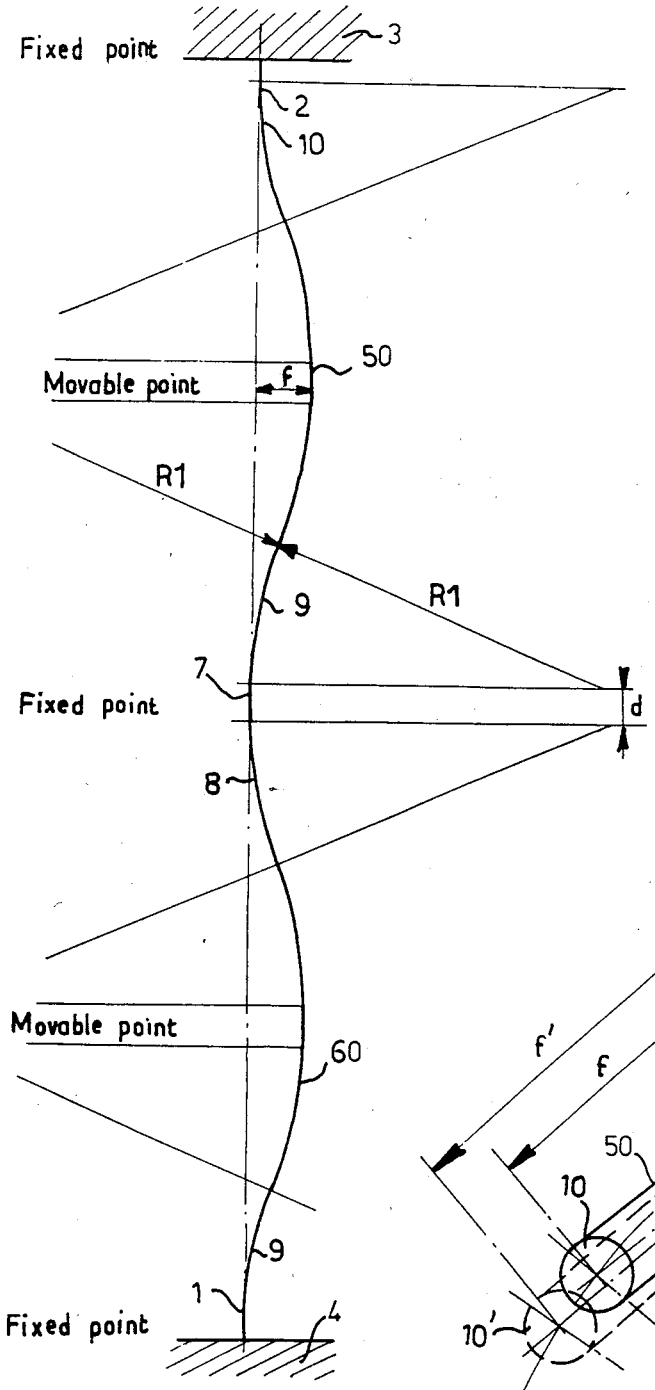
FIG. 1 is a diagrammatic elevation view of one side of a corrugated tube of the type intended to be used within the scope of the invention.

FIG. 1 illustrates diagrammatically the general shape of a tube with corrugations, suitable for putting the invention into practice. This tube 5 is mounted by its two straight ends 1 and 2 in the plates 3 and 4 provided conventionally at the base of the upper and lower domes of a steam generator or, more generally, a heat exchanger. Between these straight ends 1 and 2, the tube has bulges or undulations, only two of which have been shown at 50 and 60. These undulations 5 and 6 are located on one and the same side of a straight portion 7 which connects two successive undulations and which is aligned with the ends 1 and 2, and they are joined to this by curved portions 8 and 9, while they are joined respectively to the straight ends 1 and 2 by the curved portions 9 and 10.

Figure 2:
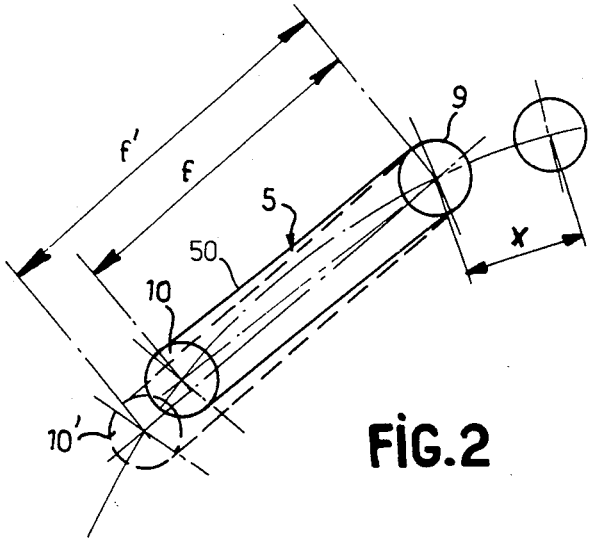
FIG. 2 is a diagrammatic and partial view of a cluster of tubes according to FIG. 1, showing the deformation which a tube can undergo at the movable level.

As emerges from in FIG. 2, the undulating tubes are arranged in such a way that the plane containing the axis of the undulations or corrugations and that of the straight portions is located substantially in the plane tangential to the circle of circumferential alignment of the tubes in a circular row of a cluster. FIG. 2, 50 also shows the corresponding bulge or corrugation 50 of FIG. 1, and the camber f of the corrugation at rest has been indicated here. During a deformation, under the effect of temperature, the camber f increases and assumes the value f', and it passes from 10 to 10'.

Now it has been proposed to provide, between the plates 3 and 4, particularly at the level (movable level) of the peaks of the undulations such as those designated in FIG. 1 by 50, concentric supporting systems, each of which is formed by a supporting strip 20 (FIGS. 3, 3A, B and C) to which is welded a cellular corrugated, zig-zag strip 21 defining alternate successive cells in which the corrugations of the tubes are accomodated. The cells are closed by means of a closing strip 22 to which the radially adjacent supporting strip 20 is welded, and so on in radially progressing rows between the cylindrical casing and a central tube located in the latter.

Consequently, at a particular movable level, the concentric supporting systems form an assembly in one piece between the cylindrical casing and the central tube, and the portions of the concentric supporting systems subtending a particular angle to the center undergo, for a particular temperature, peripheral expansions which increase from the center towards the cylindrical casing.

Figure 3:
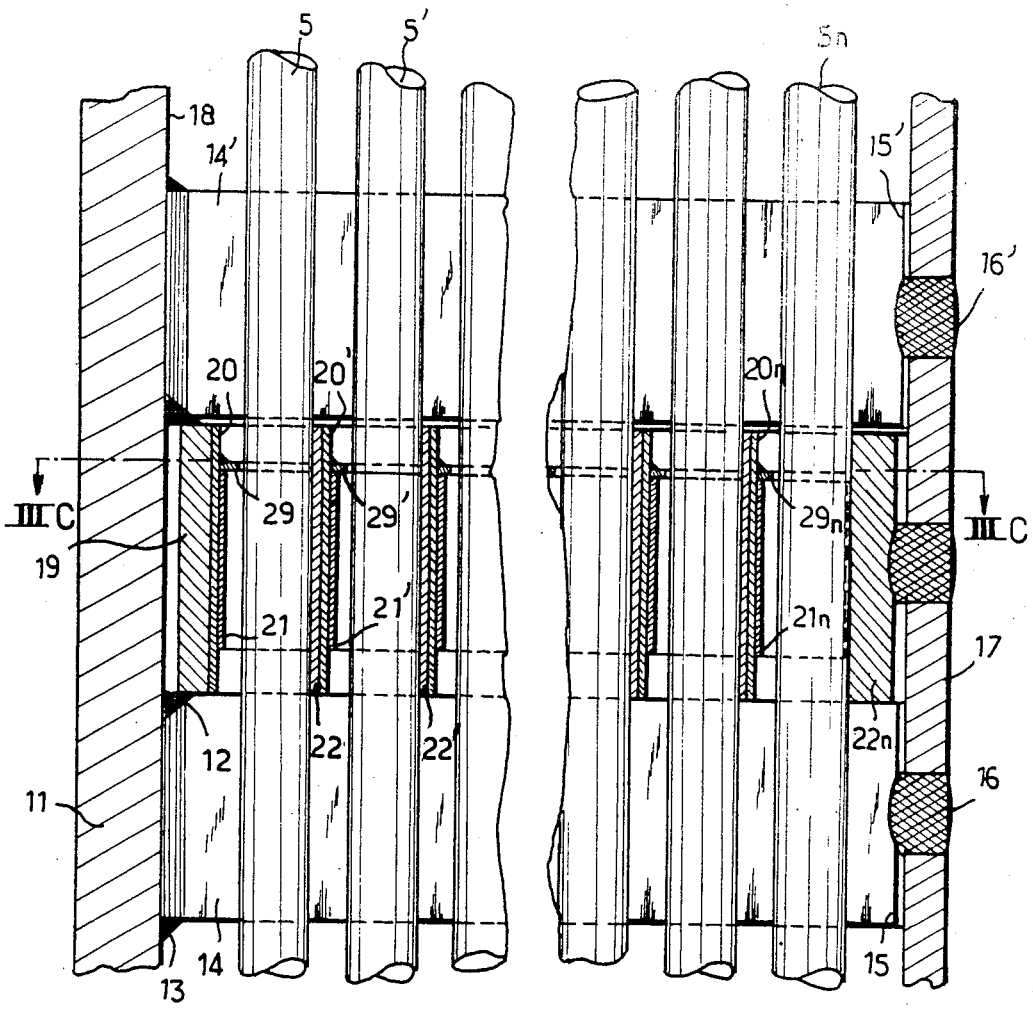
FIG. 3 shows diagrammatically a radical cross-section of the heat exchanger at the level of a tube supporting system.

To overcome this disadvantage, the invention proposes the arrangement of FIG. 3.

Below the level of the peak of a corrugation such as 50 in FIG. 1, a flat butt-welded iron bar 14 is welded at 12 and 13, and its other end 15 will be supported temporarily, as will be explained below with reference to FIG. 4, to be welded finally at 16 wall of a central tube 17.

On this radial arm 14—see FIG. 3—a ring 19 is placed in a vertical position near the inner surface 18 of the cylindrical casing 11. The annular supporting strip 20 is placed against the inner surface of the ring 19, and welded to this annular strip is the cellular strip 21 such as that described in the published French patent application filed Mar. 24th, 1978 under No. 78-08718, to which British Pat. No. 1,591,784 corresponds, and in the cells of which strip 21, tubes such as that designated by 5 are placed and held in place by the closing strip 22 welded to the cellular strip 21.

On the inside of this supporting system 20, 21, 22 for the tubes such as 5, the supporting systems 20', 21', 22' for the tube 5' are arranged, and in steps the supporting system $20_n$, $21_n$ for the tubes $5_n$, the cells of which are closed by the ring $22_n$ which is the equivalent of the closing strips 22, 22', the ring $22_n$ being welded to the wall of the central tube 17.

In this way, concentric tube supporting systems independent of one another have been produced, so that the circumferential expansion of one of the systems is independent of that of the adjacent system or systems.

Preferably, a radial arm 14' similar to the radial arm 14 is placed on the sheet of supporting systems which is produced in this way, and each radial arm 14 and 14' will advantageously consist of two flat iron bars, such as those designated by 14 and 14', which will be arranged on either side of the radial row of tubes 5, 5' . . . 5*n*.

Figure 3A:
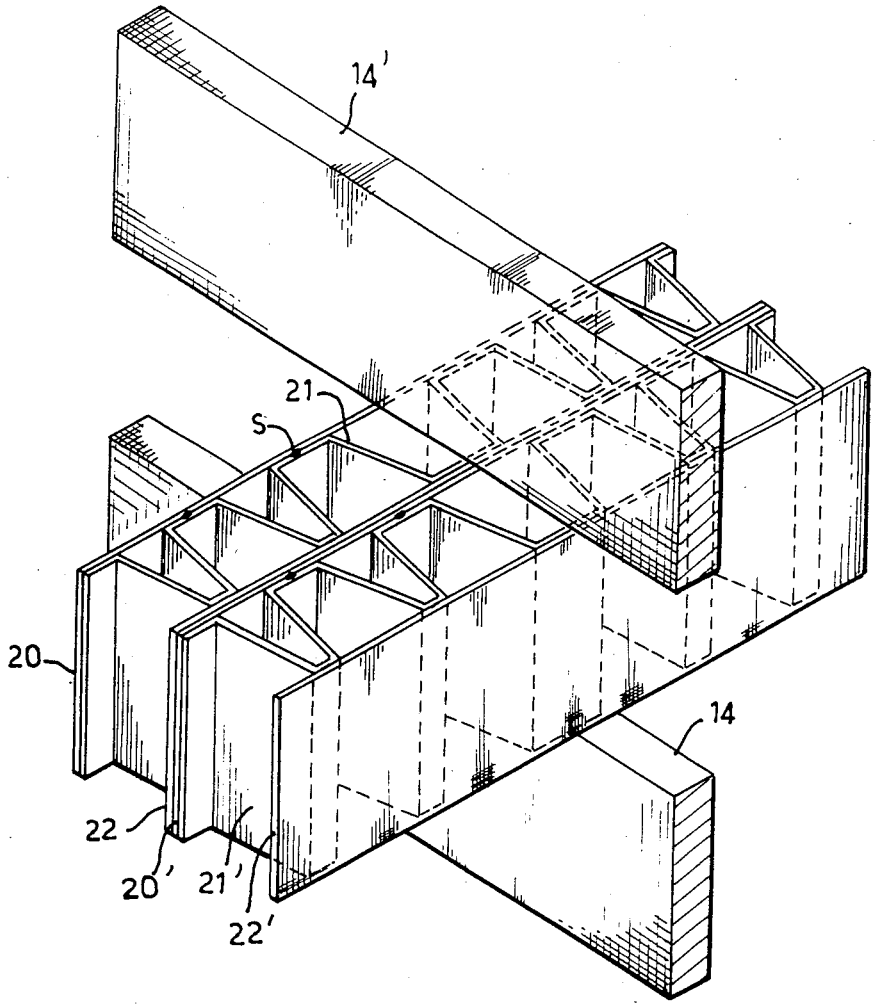
FIGS. 3A and 3B show respectively, in perspective, the arrangement of two portions of supporting systems at a movable level and at a fixed level.

FIG. 3A shows, in perspective, two pieces of two radially successive tube supporting systems between the radial arms and arranged at a movable level, e.g. at the level of bulges 50, or 60 (FIG. 1) of the tubes 5, i.e. where tubes 5 are subject to deflecting or bulging movement. The tube support systems are vertically supported on arms 14. The outer supporting system consists of the supporting strip 20 to which is welded, by spot welds such as that indicated by S, the cellular strip 21 against which the closing strip 22 is freely applied. The inner supporting system is formed in the same way by the supporting strip 20', by the cellular strip 21' and by the closing strip 22', together with the same spot weld S, the assembly of the two supporting systems being arranged freely between the radial arms 14 and 14'. And, according to the invention, there is no weld between the two supporting systems. If desired, a spot weld can be provided between the cellular strip 21 and the closing strip 22 and between 21' and 22'.

Figure 3B:
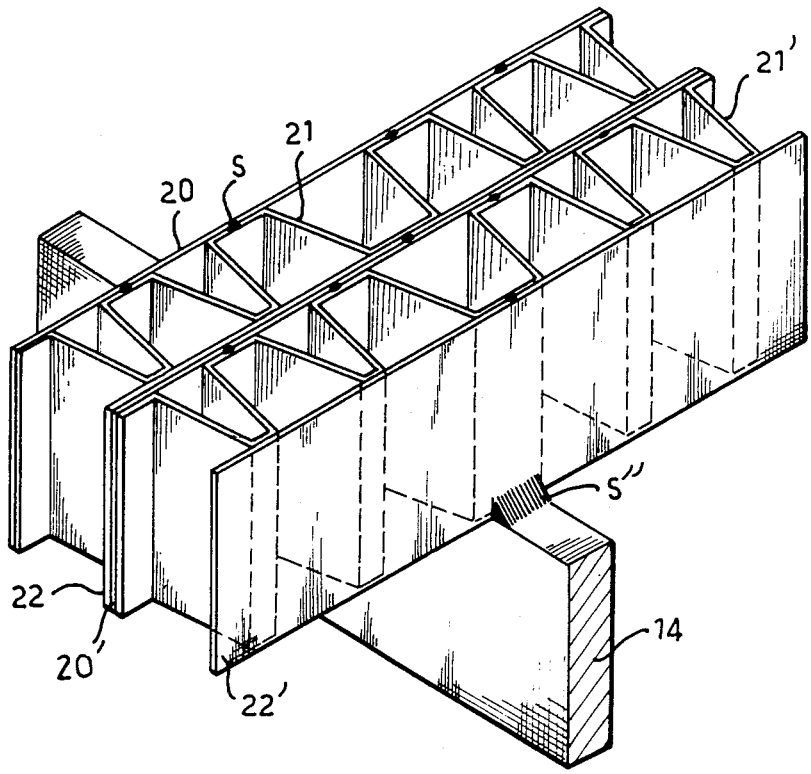

FIG. 3B shows an arrangement identical to that of FIG. 3A, but for a "fixed level", e.g. at the fixed level 7 (FIG. 1) with this double difference that (a) only the single radial arm 14 is provided and (b) a weld S" between the arm 14 and the closing strip 22' is provided; it is understood that such a weld S" can be provided between the arm 14 and the closing strip of each supporting system, such as that designated by 22, 22'.

Figure 3C:
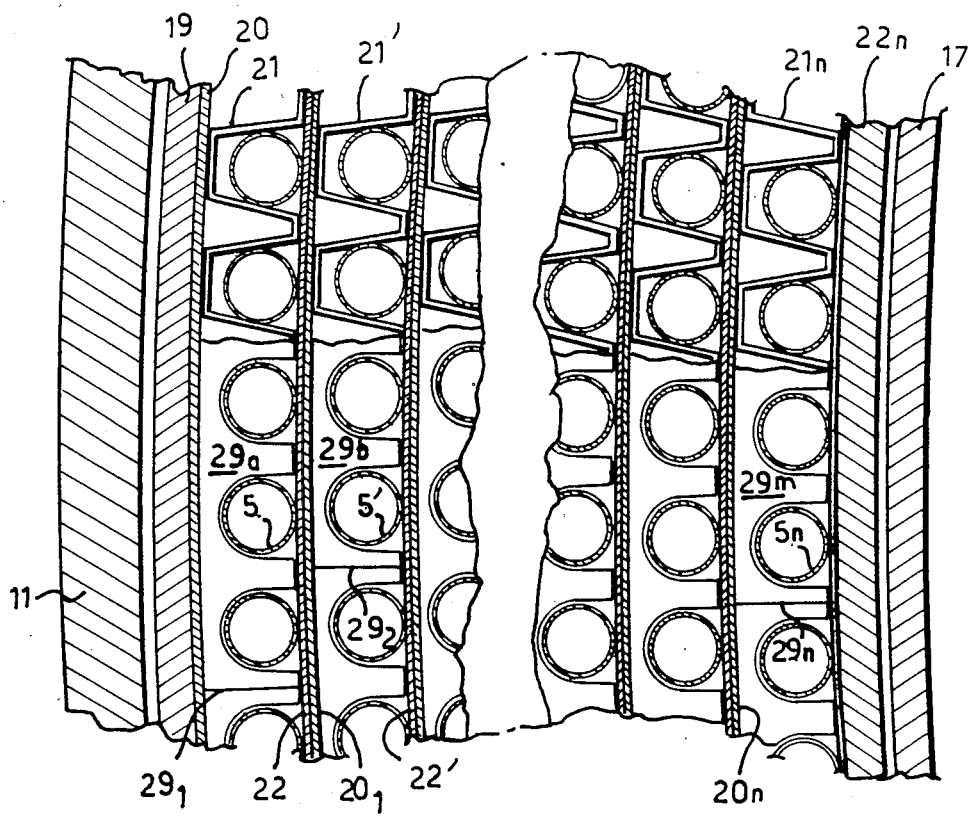
FIG. 3C is a horizontal cross-section along the line III C—III C of FIG. 3.

To control the flow of the fluid in the heat exchanger so as to obtain a better coefficient of surface heat transmission, it is envisaged that strips 29 in the form of combs, which can be seen in FIG. 3C which is a cross-section along the line III C—III C of FIG. 3, are arranged on at least some of the supporting systems.

As emerges from FIG. 3 and 3C, the combs 29, 29' . . . 29*n* are associated respectively with the rows of tubes 5, 5' . . . 5*n* and are placed flat on the cellular strips 21, 21' . . . 21*n* and held in place by welding to the supporting strips 20, 20' . . . 20*n* in such a position that the teeth of each comb 29, 29' . . . 29*n* pass between the tubes maintained by the respective cellular strips 21, 21' . . . 21*n*.

Figure 3D:
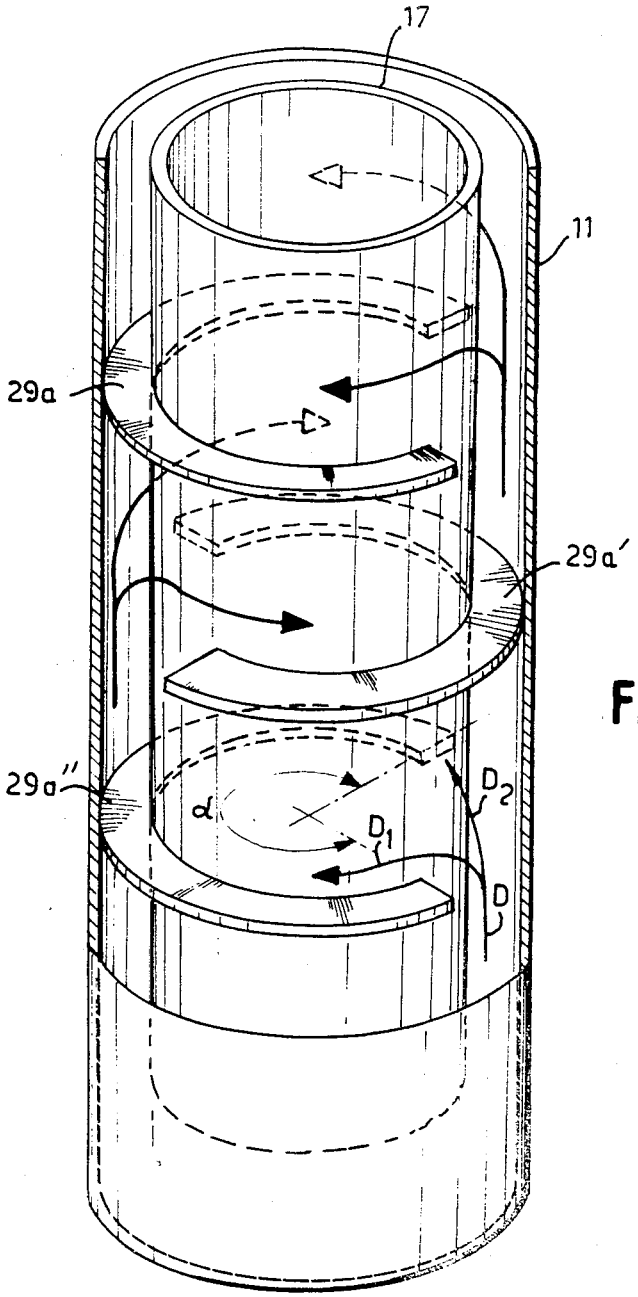
FIG. 3D is a partial diagrammatic view with an arrangement of the deflectors formed by combs.

In fact, each of the combs 29, 29' . . . 29*n* consists of partial and coextensive combs which are welded to one another along welding lines such as those indicated in FIG. 3C by $29_1$, $29_2$ . . . 29*n*, so as to extend over an arc, the value of which depends on the course to which it is intended to subject said fluid, and all of these combs constitute deflectors, of which the arrangement from one level of supporting systems to another will by explained with the aid of FIG. 3D.

Between the cylindrical casing 11 and the central tube, combs 29*a*, 29*a'*, 29*a"*, shown diagrammatically in the form of rings extending over an angle $\alpha$, are arranged respectively at the various movable and fixed levels, each of these rings forming deflectors by means of combs such as those shown in FIG. 3C. In FIG. 3D, the angle $\alpha$ is equal to 300°, and the course to which the fluid is subjected from one level to another is inclined to the maximum extent to the axis of the appliance so as to give a maximum coefficient of heat transfer at the level of the tubes not shown in this Figure. However, the angle $\alpha$ can also be equal to 240°, but in all cases, the arrangement of the rings or deflectors is symmetrical between two successive stages. And in the case of this arrangement, the fluid coming from a lower level in the direction D is distributed at the following level in the directions $D_1$ and $D_2$.

Figure 4:
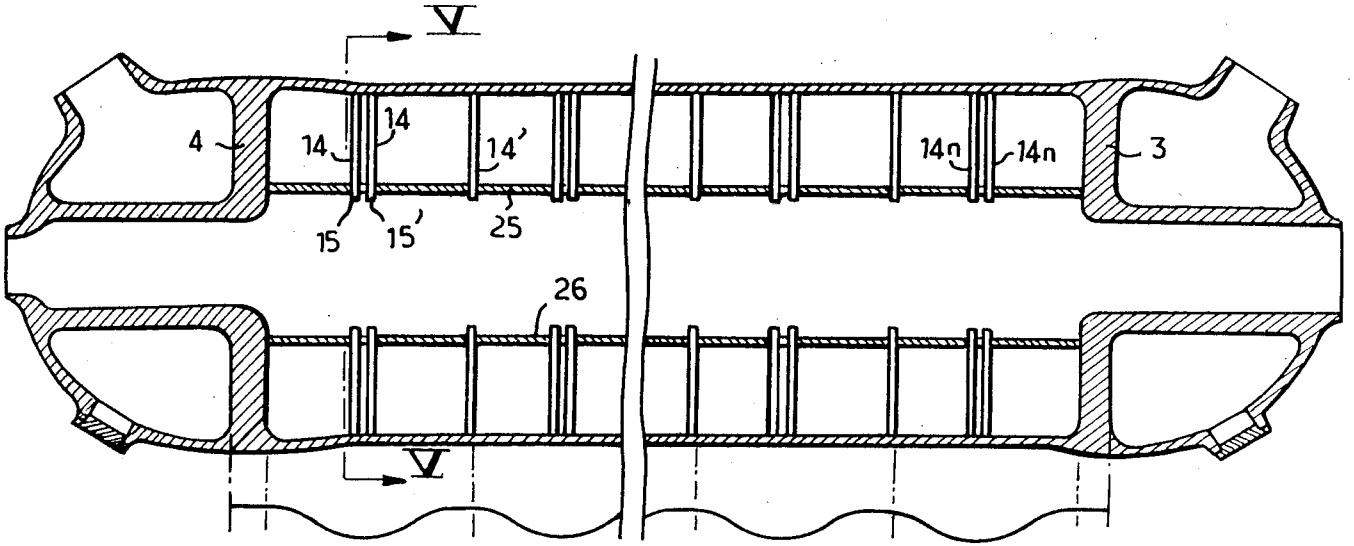
FIG. 4 is a diagrammatic axial view of an appliance according to the invention, in a horizontal position.

The arrangement of the radial arms 14 and 14' of FIG. 3 on either side of the assembly of supporting systems provided at a given level, so that a supporting system is independent of the adjacent supporting systems, is especially advantageous for assembling the clusters of tubes and supporting systems in the cylindrical casing placed horizontally, particularly on electrical turning devices, as shown in FIGS. 4 and 5, in which only two turning devices 23 and 24 have been shown, the presence of these turning devices enabling the cluster of tubes to be assembled in sectors of 60°, for example delimited by the pairs of radial arms 14-14, 14'-14' . . . 14*n*-14*n* .

In this type of assembly, the inner ends 15, 15' of the radial arms such as 14, 14' are mounted in orifices made in temporary flat iron bars 25, 26 which are fixed to the plates 3 and 4 and which are removed for installation of the inner cylinder 17 (FIG. 3). After the cluster of tubes and supporting systems have been installed, the flat iron bars 25, 26 are eliminated and the central tube 27 is installed, as shown in FIG. 6.

Figure 6:
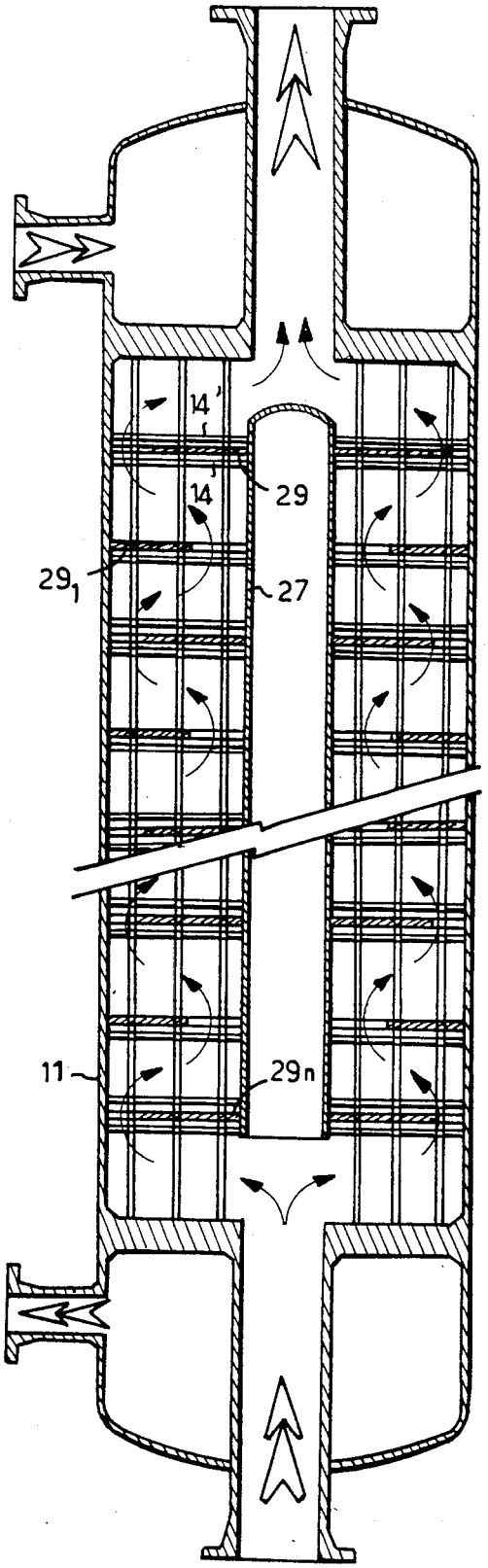
FIG. 6 shows diagrammatically the arrangement of the deflectors produced by means of combs.

FIG. 6 is an axial and diagrammatic cross-section of the apparatus according to the invention and shows the presence of deflectors 29, $29_1$ . . . $29_n$ which are made by means of combs 29 to 29*m* placed flat on the cellular strips 21 to 21*n* so that the teeth pass between the tubes of a circular row, as described with reference to FIGS. 3 and 3A.

Each deflector 29, $29_1$ . . . $29_n$ can extend, in this case, over an arc of 360° and forms a ring, the radial thickness of which is less than the radial distance between the cylindrical casing and the central tube, with this special feature that the successive rings are arranged alternately near the cylindrical casing and near the central tube so as to subject the rising fluid to an undulating course. It will be noted that the radial thicknesses of the successive rings are different from one another, whereas the radial thicknesses of the rings which have the same arrangement are equal to one another.

It emerges from the foregoing that assembly of the circular supporting systems and their arrangement in sectors of 60°, 120° or 180°, and that of the corresponding sections of the supporting strip to which the cellular strip is welded, can be prepared in advance, outside the cylindrical casing, according to the arrangement to be adopted for distribution of the tube, thus leading to mass production of the supporting system.

FIG. 7 shows a diagram serving to determine this distribution in the case where assembly in sectors of 60° is adopted.

The procedure begins by drawing a regular hexagon 29 with, as its centre, the start O of two axes of coordinates X, Y. The mid-perpendiculars 30, 31 are drawn to the sides 30, 31. In the sector 30-O-31 the location of a first tube 32 is marked at the apex of the hexagon, and, after drawing concentric circles at the radial pitch p, the locations of the other tubes are marked, and the number of these increases by one unit for each radial pitch, between the mid-perpendiculars 30, 31, with a symmetry relative to the axis OY which bisects the angle 30, O, 31. The procedure is identical for preparing the diagram for the other sectors of 60°, and it should be noted that the radial arms will be arranged parallel to the mid-perpendiculars 30, 31.

Once the layout has been made, the diameter of the center tube 37 is determined, this tube being drawn in FIG. 8 in which there is no need to provide corrugated tubes.

The preceding description is given only by way of non-limiting example, and it goes without saying that alternative forms are possible within the scope of the invention.

What is claimed is:

1. An improved heat exchanger, expecially for a steam generator, capable of accomodating differential thermal expansion of its components, having a plurality of linear heat exchange tubes (5) arranged in an array of concentric circular rows with their axes vertical and parallel;

a cylindrical casing (11) surrounding said linear heat exchange tubes;

a plurality of concentric supporting systems, each maintaining the arrangement of a circular row of the heat exchange tubes by permitting lateral deflecting movement of the tubes at certain movable axial levels while securely maintaining the tubes in vertical alignment at a plurality of certain axial fixed levels, a plurality of radial arms (14, 14' . . . 14*n*) secured in fixed axial relation to said cylindrical casing (11), each of said tube supporting systems at the movable axial levels including a zig-zag strip (21, 21' . . . 21*n*), bent in a circle and having alternately facing trapezoidal cells, a surrounding circular support strip (20, 20' . . . 20*n*) welded to engaging portions of said zig-zag strip, and a closing strip (22, 22' . . . 22*n*) having one face positioned at and contacting the side of a zig-zag strip remote from the supporting strip and its other face movably contacting the support strip of the concentrically adjacent tube supporting system, said supporting systems being supported at one of said axial levels, after installation of the tubes, by at least one of said radial arms;

wherein at least some of the tube supporting systems at said movable axial levels (20, 21, 22; 20', 21', 22'; . . . 20*n*, 21*n*, 22*n*) are independent of the tube supporting system concentrically adjacent, in radial direction, in order to permit certain of said circular rows of the heat exchange tubes (5) to undergo thermal expansion differing from the thermal expansion of the tubes of others of said circular rows without exerting damaging mechanical stresses on the tube supporting systems, and to form groups of tube supporting systems.

2. Improved heat exchanger according to claim 1, wherein said heat exchange tubes (5) have, at respective axial levels along their length, alternating straight portions (7, 9, 10) and outwardly bulged portions (50, 60).

said bulged portions having peaks of maximum deflection (f);

said straight portions defining axial levels of said heat exchange tubes which are of relatively fixed diameter during thermal expansion of said tubes and said bulged portions defining axial levels of said tubes which are movable during thermal expansion;

a plurality of vertically staggered tubes supporting systems are provided, wherein individual ones of the tube supporting systems are located at the axial levels of the straight portions and at the axial levels of said bulged portions;

wherein the tube supporting systems at each of said axial levels of said bulged portions are independent of the supporting systems at the same movable level;

and wherein a plurality of vertically staggered radial arms (14, 14' . . . 14*n*) are provided, positioned above and below the supporting systems of at least some of the systems located at the level of the bulged portions of said tubes (5).

3. Improved heat exchanger according to claim 1, including a central tube (17) located centrally within the casing (11);

and wherein the radial arms (14) extend between the cylindrical casing (11) and the central tube (17).

4. Improved heat exchanger according to claim 3, wherein, for at least one of said tube supporting systems, two radial arms are provided, each comprising a spaced flat butt-welded iron bar and defining a predetermined distance therebetween, said tube supporting system being located within said predetermined distance.

5. Improved heat exchanger according to claim 2, including a central tube (17) located within the casing (11);

two concentric rings one (19) of which is located near the inner surface of the cylindrical casing and the other (22*n*) is located near the outer surface of the central tube (17), said radial arms (14) extending between said two concentric rings.

6. An improved heat exchanger according to claim 2, characterised by a deflector means comprising a comb (29) having teeth and said comb being associated with each supporting system, the comb (29) being placed flat on the zigzag strip and welded to the associated supporting strip (20), in such a way that teeth of the comb pass between the tubes (5 . . . 5*n*) and shut off to the maximum extent the passages between the cells and tubes.

7. An improved heat exchanger according to claim 6, characterised in that, at a particular level, the combs (29) are arranged in arcs of a circle substending angles measured with respect to the centre of up to 300°, and the combs of the successive levels are offset angularly between them so as to subject the fluid passing on the outside of the heat exchanger tubes to an oblique course substantially perpendicular in relation to the combs.

8. An improved heat exchanger according to claim 6, further including a central tube located within said casing; and said deflector means comprising a plurality of stacked rings of combs extending over 360° and having a radial thickness less than the radial distance between the cylindrical casing and the central tube, the successive rings being located alternately near the cylindrical casing and near the central tube.

* * * * *